US008012031B2

(12) United States Patent
Stuart et al.

(10) Patent No.: US 8,012,031 B2
(45) Date of Patent: Sep. 6, 2011

(54) REVOLVING WATER RIDE AND METHOD OF MOVING RIDE PARTICIPANTS BETWEEN POOLS OF DIFFERENT HEIGHT

(76) Inventors: Alexander Stuart, Newhaven (GB); Douglas Murphy, Glasgow (GB)

( * ) Notice: Subject to any disclaimer, the term of this patent is extended or adjusted under 35 U.S.C. 154(b) by 648 days.

(21) Appl. No.: 11/975,115

(22) Filed: Oct. 17, 2007

(65) Prior Publication Data

US 2009/0105003 A1 Apr. 23, 2009

(51) Int. Cl.
*A63G 21/18* (2006.01)
*A63H 23/10* (2006.01)

(52) U.S. Cl. ..... 472/117; 472/128

(58) Field of Classification Search ..... 472/116, 472/117, 128, 136; 182/48–52; 104/69–70
See application file for complete search history.

(56) References Cited

U.S. PATENT DOCUMENTS 913,243 A * 2/1909 Sonntag ..... 104/57
3,968,856 A * 7/1976 Keen et al. ..... 182/48
4,487,411 A * 12/1984 Ahrens ..... 472/116
5,433,671 A * 7/1995 Davis ..... 472/117
6,108,988 A * 8/2000 Nagelski et al. ..... 52/187

FOREIGN PATENT DOCUMENTS

WO WO-98/45006 10/1998

* cited by examiner

*Primary Examiner* — Kien T Nguyen

(57) ABSTRACT

A water ride for transporting ride participants between portions of a water attraction disposed at different heights, for example, pools situated at various levels in a water leisure park, includes an outer support tube within which a hollow spiral coil (screw) is constructed internally of the tube and securable to the tube. Advantageously, the manner of securement permits removal of at least a portion of the spiral coil as necessary or desirable for performing maintenance and/or replacement. The spiral coil sufficiently engages the inside of the tube, thereby creating at least a restriction to the passage of water between adjacent pockets contained between the thread pitch defined by the spiral coil. Ride participants are moved along with water pockets trapped between the pitch of the internal profile presented by the combination of spiral coil and tube from one end of the tube/spiral coil combination to the other end by rotation of the tube in an appropriate direction.

20 Claims, 8 Drawing Sheets

REVOLVING WATER RIDE AND METHOD OF MOVING RIDE PARTICIPANTS BETWEEN POOLS OF DIFFERENT HEIGHT

BACKGROUND OF THE INVENTION

The present invention relates to a water ride, and more particularly a revolving water ride for transporting ride participants between portions of a water attraction disposed at different heights, for example, pools situated at various levels in a water leisure park.

Water rides which move a user from an upper level to a lower level are well-known in the leisure industry. Such water rides take the form of slides or flumes where the user is carried downhill both by the flow of water and gravity. However, once a user has descended by various routes to the lower levels of a water park, which is a combination of a number of different water rides, the only means of ascending to the upper levels is by way of a traditional stairway or ladder. Participants would ordinarily have to climb steps in order to reach higher level water rides while having to handle an inflatable carrier or other floatation device, which is often cumbersome, in order to prepare for a down-hill water flume ride, creating potential hazards associated with users situated on high stairways. In addition, use of inflatable carrier gantries, hoists or conveyor systems, are also frequently essential for bigger two and four person inflatable carriers, requiring additional installations.

The principle of the Archimedes' screw has been used for the upward transport of water from a low-lying body of water since at least the times of ancient Greece. The basic device consists of a screw housed inside a hollow pipe. In operation, a bottom of the tube, oriented in an inclined position, is placed in a body of water, such that when the screw is caused to rotate, water is trapped between the threads of the screw and transported longitudinally along the spiral path defined by the screw thread to the top end of the tube, where it is discharged.

Various modifications on this original approach are know to have been applied generally to the upward transport of various substances, including articles and living creatures, such as, for example, fish.

Further known variations of the basic principle afforded by the Archimedes' screw have been adopted in specific connection with water park applications, as disclosed, for example, in PCT Published Application WO 98/45006. The described water ride, for use in a leisure park, includes an inclined hollow rotating tube having a screw thread on an internal surface thereof. According to this approach, one end of the tube is positioned at a lower water level and the opposite end of the tube is positioned at a higher water level such that the tube assumes an inclined orientation between two pools of water different in height. A participant of the ride entering the tube at the lower water level, for example, on an inner tube or other floatation device, is carried to the higher water level in water pockets formed between the pitch of the thread within the tube and which are moved in the longitudinal direction along the internal screw thread as the tube rotates about its axis.

While, in theory, effective for carrying out the transfer of rider participants between a lower pool and an upper pool, the previously described arrangement is difficult to manufacture because of its configuration as a convoluted pipe having the screw carrier profile molded into the varying external circumference presented thereby. In addition, such shape results in undesirable flexibility over a length thereof in commercial practice, requiring an external framework for stabilization, onto which support tracks would additionally have to be mounted to enable the unit to rotate.

It would therefore be desirable to have a water ride which overcomes the drawbacks of the prior art.

An object of the present invention, therefore, is to overcome the above noted disadvantages of the conventional water rides, and to provide a water ride which effectively transports ride participants between bodies of water disposed at different heights.

SUMMARY OF THE INVENTION

Briefly stated, the invention comprises an outer support tube within which a hollow spiral coil structure defining a generally helical screw thread is constructed internally of the tube and which is securable to the tube. Advantageously, the manner of securement permits removal of at least a portion of the spiral coil structure as necessary or desirable for performing maintenance and/or replacement. The spiral coil structure is arranged within the tube in such a manner as to sufficiently engage the inside of the tube, thereby creating at least a restriction to the passage of water between adjacent pockets contained between the thread pitch defined by the spiral coil structure.

The internal profile presented by the combination of spiral coil structure and tube is designed specifically to carry people between the pitch to a higher water level (or lower water level, as desired). The depth of the internally threaded profile controls a given quantity of water being retained between the pitch, advantageously of sufficient depth and volume to provide a buoyant ride for inflatable carrier use, until the participant reaches the exit area at the top of the tube, where the ride participants of the water ride are ultimately launched down a ramp or the like, or simply released into a pool, along with the water contents of the particular pocket present between the pitch in which the rider (or riders, when multiple participants are in a same raft or the like) ascended.

The continuous water supply which travels though the water ride and which is expelled along with the ride participant, advantageously assists the riders progress after leaving the tube and carrying them to the next feature, which can be of any number, including, for example, a flume ride down to the beginning start area, a further flume water ride, or to another revolving water ride according to the invention, taking them up to one of several higher feature locations, all depending on what each particular venue has to offer.

The continuous internal carrier profile of the spiral coil creating the pitch, which in turn creates the pockets of water therebetween, is advantageously of a removably pre-fixed, but totally separate, constructional element (or assembly of elements) to that of the outer support tube, permitting optional design layouts and technical changes, maintenance, etc. to the internal profile to be easily carried out, without disturbing the outer support tube comprising the core of the installation, or the vital drive and operational equipment associated with rotating the tube. This advantageously reduces down time to a minimum and resultant loss to income, vital factors in the successful running of a water amusement venue.

Evacuation of participants in the event of an emergency is a simple and safe exodus. In the event of a contingency, the rotation can be reversed, with the occupants being returned to the start area by operation of the same principle being relied upon for an ascent. Should the rotational movement need to be stopped entirely during public use, thereby precluding a rotational reversing, escape is easily achieved by the participant sliding over each internal screw profile defined by the open (hollow) spiral coil, and down into the retained water of the next and subsequent pocket formed between an adjacent pitch, in order to reach the lower entry start area.

Because of the relatively large scale of a water ride capable of transporting ride participants within an interior thereof, the spiral coil structure and/or the outer tube is advantageously comprised of an assembly of sub-elements/segments which collectively defines the internal helical thread and/or the outer tube configuration when mutually secured to one another.

The above, and other objects, features and advantages of the present invention will become apparent from the following description read in conjunction with the accompanying drawings.

DETAILED DESCRIPTION OF THE INVENTION

Figure 1:
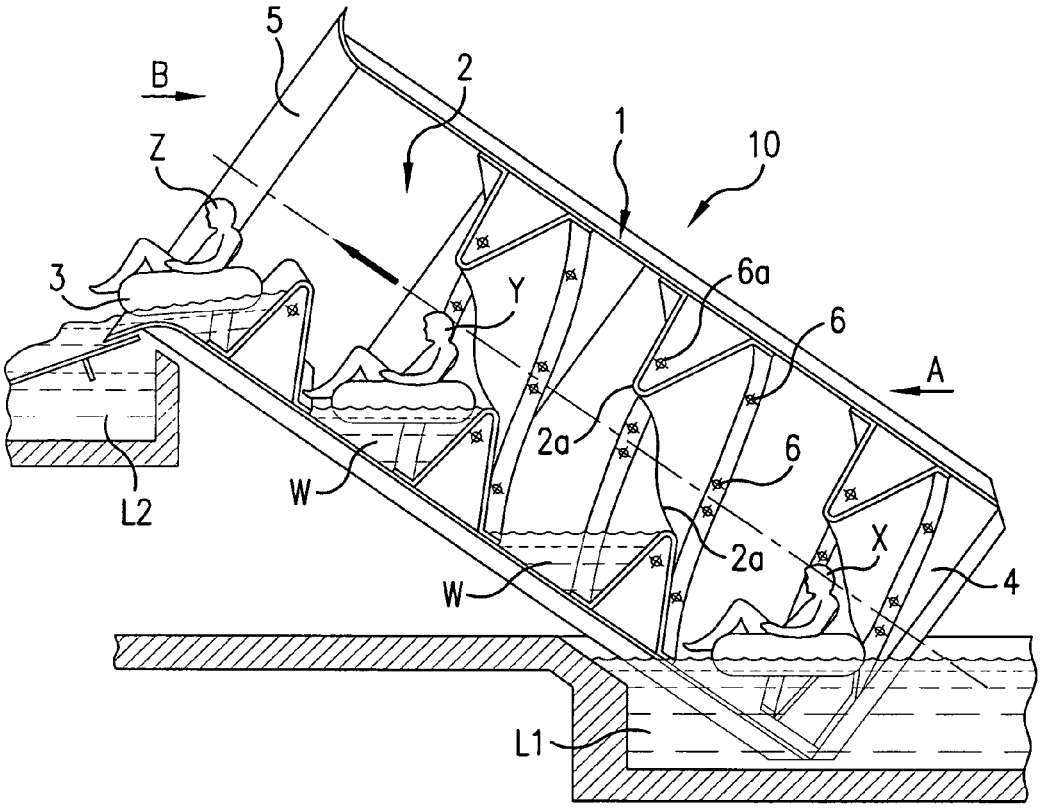
FIG. 1 is a cross-sectional side elevation schematic view of the water ride in accordance with an embodiment of the invention.

Referring to FIG. 1, a revolving water ride, generally designated 10, depicts three ride participants X, Y and Z ascending from a lower water level L1 to a higher water level L2. The water ride 10 comprises an inclined outer support tube 1 and a spiral coil structure 2 defining an internal screw thread 2*a* which is inserted into and fixed to outer tube 1. Spiral coil structure 2 is advantageously dimensioned such that a depth of the internal thread 2*a* is sufficient to carry a body (pocket) of water W which can support the ride participants X, Y and Z with or without a floating carrier 3, such as a tire inner tube, as depicted. A first end 4 of the outer tube 1 is submersed in the water at water level L1 and a second end 5 of the tube 1 allows water W carried by the internal screw thread 2*a* to empty into water level L2. It is clear from FIG. 1 that the water ride will operate in a similar manner to an Archimedes' screw when the tube 1 is rotated in a direction appropriate to thread type, i.e. right handed or left handed (clockwise about its axis when viewed in direction A of FIG. 1, the example shown employing a left handed thread) to lift the user from water level L1 to water level L2 on the body of water W moving along the internal screw thread 2*a*. If the direction of rotation is reversed, participants X, Y and Z can descend from water level L2 to water level L1. However, to fulfill this functional contingency, the second end 5 of the tube 1 would have to be submersed in water level L2 if both ascent and descent by the water ride is a requirement.

As can be seen in the example of FIG. 1, advantageously, the internal screw thread 2*a* will only extend partially radially inward from the inside of the outer tube 1, such that there is a central hollow area which is not obstructed in any way by the configuration of the screw thread 2*a*, in order that there is a clear view through the tube 1 and spiral coil structure 2. This feature will improve safety aspects of the water ride and facilitate evacuation should the water ride break down during use, as described more fully below.

Figure 2:
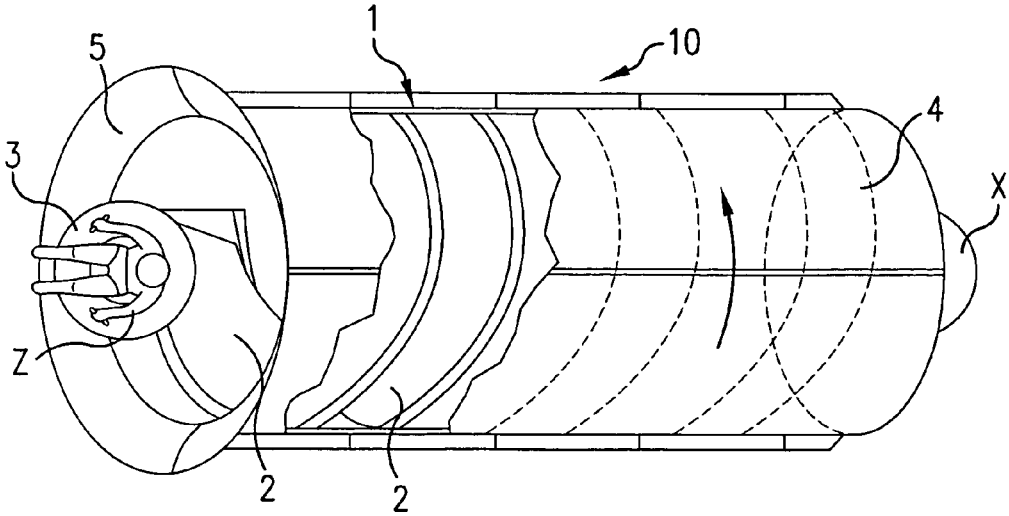
FIG. 2 is plan schematic view of the embodiment of FIG. 1.

FIG. 2 is a plan view of the water ride 10, depicting entry and exit of user X and Z, respectively, from the water ride 10. The outer tube 1 can be made to different dimensions thereby varying the number of users. However, the depth of the internal screw thread 2*a* defined by the installed spiral coil structure 2 should advantageously be sized to allow body of water W held therein to be sufficient to buoyantly support and transport the user. The angle of inclination of the outer tube 1 can also be varied to suit location requirements.

While it is possible within the context of the invention to produce outer tube 1 and/or spiral coil structure 2 each as a single element, in accordance with a particularly advantageous embodiment, outer tube 1 is comprised of tube sub-elements which can be assembled to collectively describe the outer tube 1.

Figure 3A:
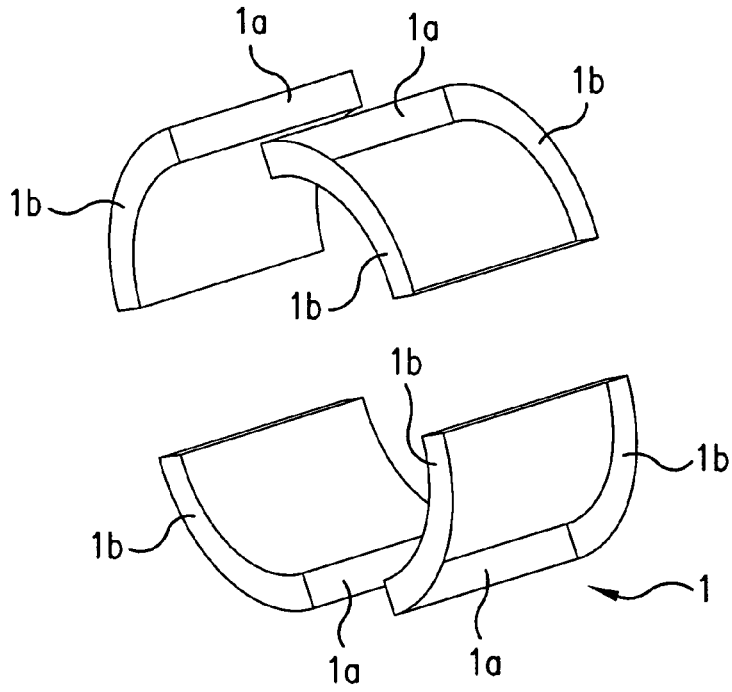
FIG. 3*a* is a perspective view of four 90 degree tube sub-sections which collectively define an axial segment of the outer tube.
Figure 3B:
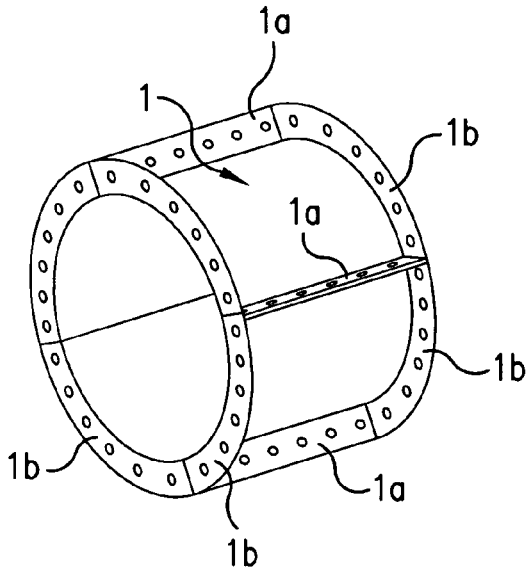
FIG. 3*b* is the assembled axial segment of FIG. 3*a;*

Referring to FIGS. 3*a* and 3*b*, an axial segment of outer tube 1 is depicted as being made up of four sub-elements (circumscribing 90 degrees each) which are assemblable to form a partial axial extent of the desired length of outer tube 1. As shown in the figures, each sub-element of tube 1 includes flanges 1*a* for mutually affixing circumferentially adjacent sub-elements of tube 1, and flanges 1*b* for affixing axially adjacent sub-elements of tube 1. The flanges 1*a*, 1*b* conveniently have multiple holes for receiving bolts therethrough for fixation by nuts, thereby retaining adjacent sub-elements of tube 1, one to the another. It will, of course, be understood that other means for mutually fixing the sub-elements can be practiced without departure from the invention. In addition, rather than extending 90 degrees, each sub-element could be designed to circumscribe other portions of the total circumference of the tube 1, for example, 180 degrees, in which case only two sub-elements would be necessary to define an axial segment of tube 1.

Figure 4A:
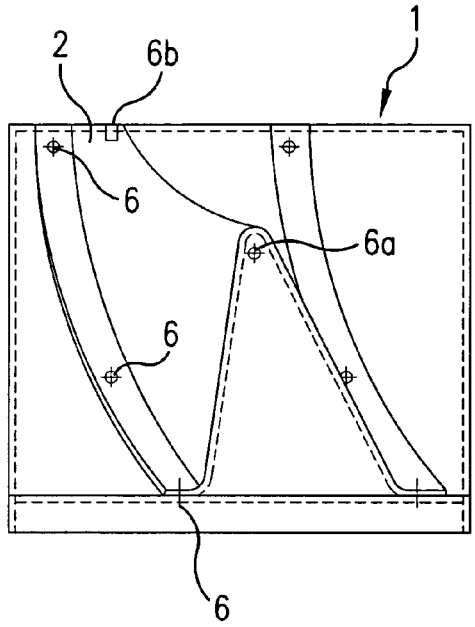
FIG. 4*a* is a side elevation of an embodiment of a spiral coil segment (applied to an outer tube sub-section) which, when assembled to like coil segments, collectively presents the helical internal profile received within the outer tube.
Figure 4B:
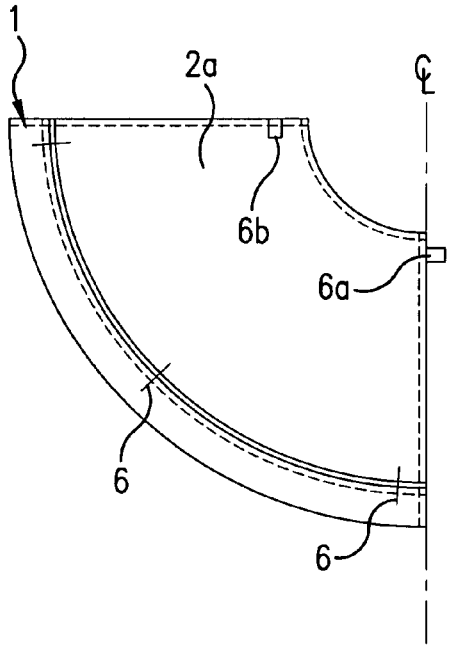
FIG. 4*b* is an open end elevation of the embodiment of FIG. 3*a;*
Figure 4C:
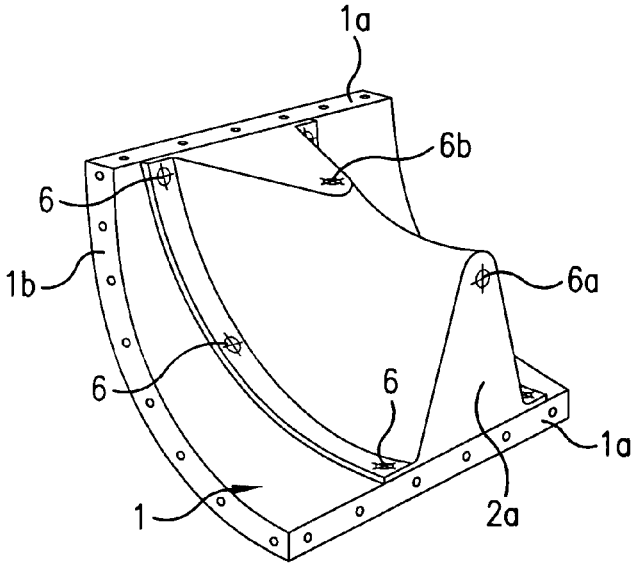
FIG. 4*c* is a perspective view of the spiral coil segment assembled to the tube sub-section of FIGS. 4*a* and 4*b;*

In similar fashion, spiral coil structure 2 may be comprised of a collective assembly of coil segments 2', each which extends over a portion of the circumference of the outer tube 1. For example, as shown in FIGS. 4*a*, 4*b* and 4*c*, an embodiment of a coil segment 2' attached to a sub-element of tube 1 is configured to extend over 90 degrees, there being 4 coil segments 2' required for a complete 360 degree rotation of spiral coil structure 2 (i.e., one pitch). For example, in the embodiment shown in FIG. 5*a*, which provides accommodations (i.e., water pockets between the pitch of the treads) for six ride participants, 24 of the coil segments 2' are required.

The coil segments 2' each includes a pin 6*a* and a bushing 6*b* in which the pin 6*a* of an adjacent coil segment 2' is receivable. Pin 6*a* and bushing 6*b* serve to align the adjacent coil segments 2', and retain their relative positioning, particularly at a junction therebetween, when the coil segments 2' are fastened to the interior of the outer tube 1.

Spiral coil 2*a* is affixed to the interior of the outer tube 1 in suitable fashion. For example, countersunk screws 6 extending through holes in flanges of the coil segments 2', as shown in FIGS. 4*a*, 4*b* and 4*c*, securely hold the coil segments 2' to the sub-elements of outer tube 1.

The contact surfaces of the flanges of both the sub-elements of the tube 1 and those of the coil segments 2' are advantageously sealed with a suitable sealant to inhibit leakage of water at the junctions therebetween. It is noted, however, that in this regard, since it is undesirable that any water that may inadvertently seep into the interior of the screw thread profile 2*a* remain trapped therein, advantageously, only the upwardly facing flanges of the coil segments 2' which actually contact the water pockets W are sealed, so that any water entering an interior of the screw thread profile 2*a* will drain into an adjacent pocket of water between the next lower pitch. More advantageously, further structural accommodation is provided which facilitates the drainage of accidental leakage of water into an interior space of the screw thread profile 2*a*, such as provision of an intentional drainage clearance.

In general terms, the outer tube 1 is mounted in suitable fashion, for example on standard thrust bearings, and rotated using a rotational drive mechanism. Such a drive mechanism, required to rotate the outer structural tube 1, can be one of several power sources, that of electrical, hydraulic or water, the latter being the preferred choice as the most environmentally friendly and energy saving system, together with a high safety factor. The rotational drive housing is located under the outer support tube 1, in a designated area, the specific location of which depending on the requirements of each particular site layout.

An installation support system for rotationally mountable retention of the outer tube 1, and including a rotational mechanism for transferring rotational force thereto from the drive mechanism, is conveniently comprised of materials normally associated with water entertainment venues, i.e., that of various steel fabrications, with suitable cladding, to conform with health and safety standards as may be required, thus keeping the public away from the rotational mechanism.

Figure 6:
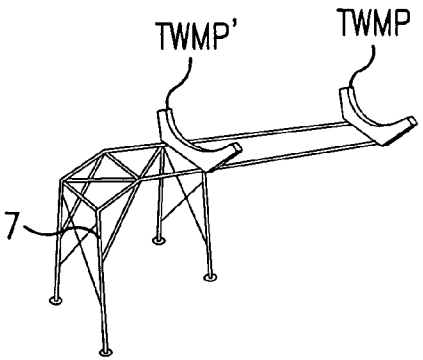
FIG. 6 is a perspective view above and at a side of the structural support system used to support the embodiment of FIGS. 5*a* and 5*b;*
Figure 5A:
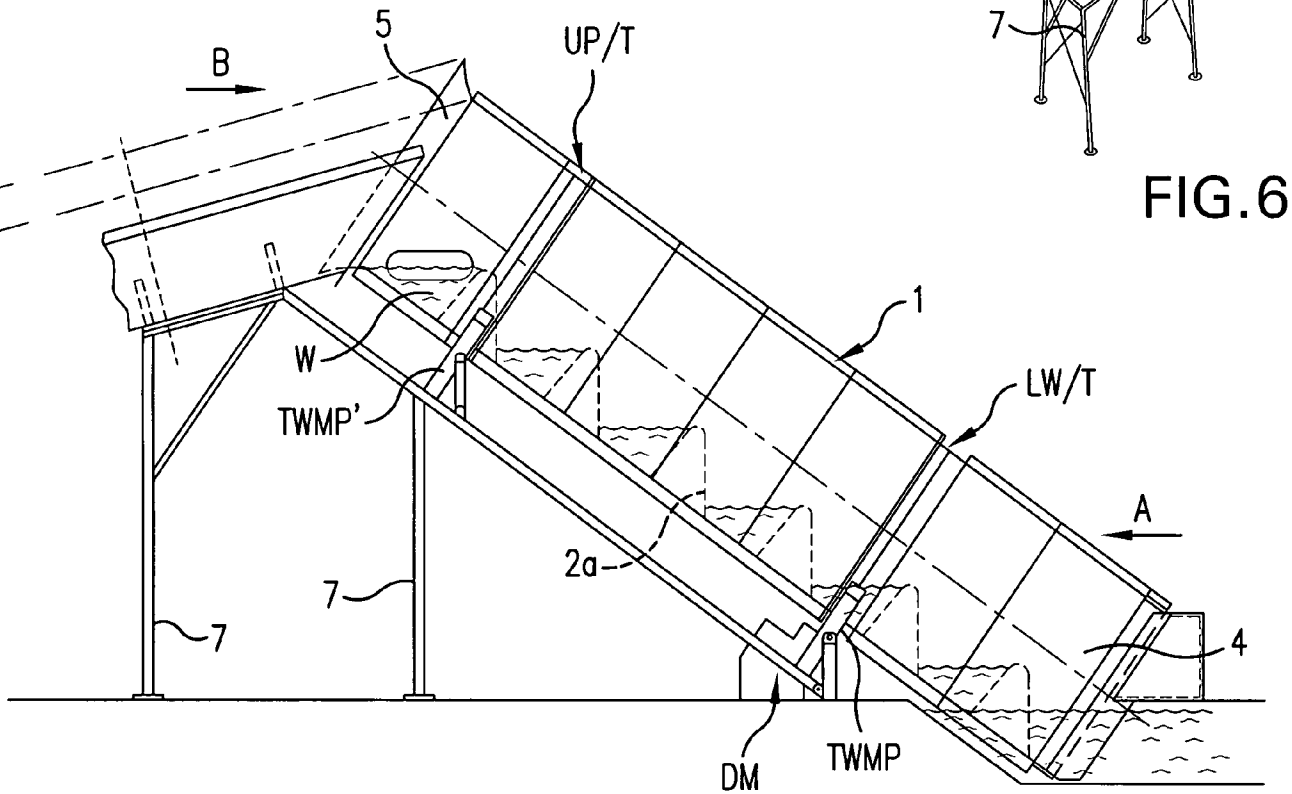
FIG. 5*a* is a side elevation of an operational embodiment in accordance with the invention showing an exemplary manner of support and rotational drive.
Figure 5B:
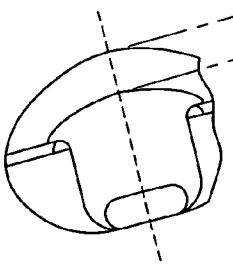
FIG. 5*b* is an end view of an upper end of the outer tube of the embodiment of FIG. 5*a;*

Turning now to FIGS. 5*a*, 5*b* and 6, an embodiment illustrating a convenient manner of support and rotation of water ride 10 in furtherance of the above guidelines includes a support structure 7 made, for example, in a form of a steel skeletal structure, and carrying thereon a pair of track wheel main plates TWMP, TWMP' for providing resting support of the outer tube 1 with spiral coil structure 2 assembled therein. Lower track wheel main plate TWMP imparts rotational drive from a rotational drive mechanism DM to the outer tube 1 resting thereon, as described more fully below with reference to FIGS. 7-10. Upper track wheel main plate TWMP' is similar in construction to lower track wheel main plate TWMP, differing, however, in that upper track wheel main plate TWMP' supports less load and does not contribute to the rotational drive of the outer tube 1.

Figure 7:
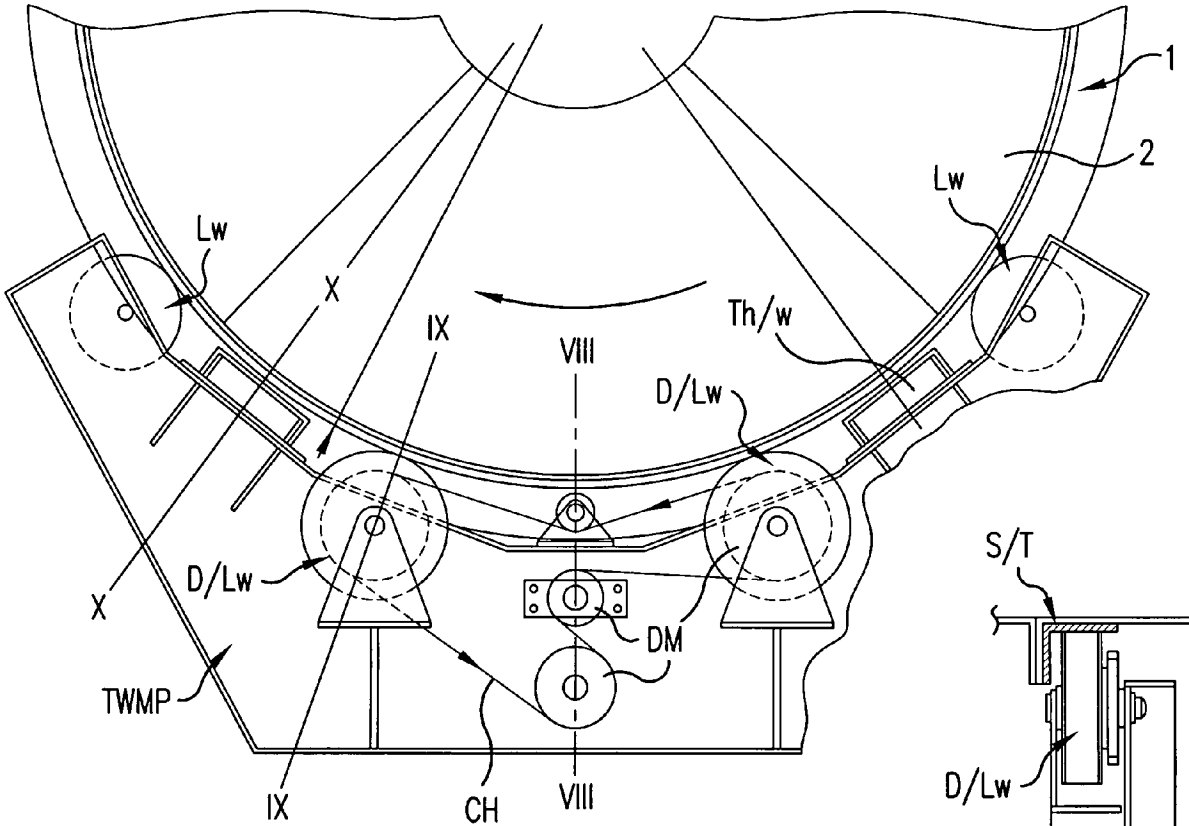
FIG. 7 is a detail view at A in FIG. 5*a* of a rotational drive mechanism carried on the support structure of the embodiment of FIGS. 5*a*, 5*b* and 6.
Figure 8:
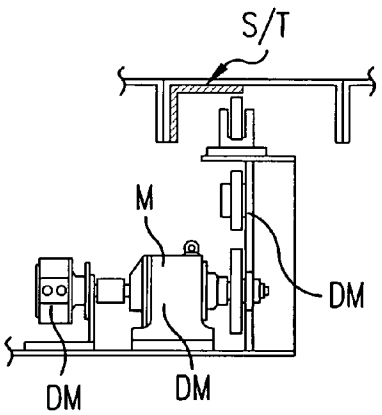
FIG. 8 is a view taken along line VIII-VIII in FIG. 7.
Figure 9:
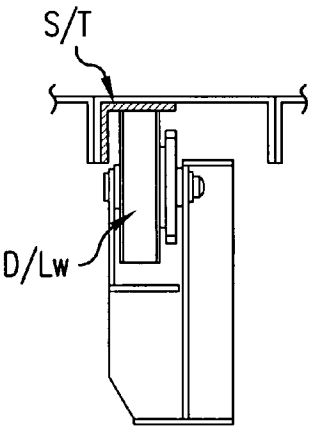
FIG. 9 is a view taken along line IX-IX in FIG. 7.
Figure 10:
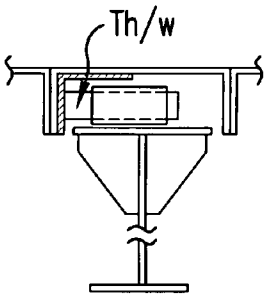
FIG. 10 is a view taken along line X-X in FIG. 7.

FIG. 7 is a detail elevational view taken generally in the direction of arrow A in FIG. 5*a* of rotational drive mechanism DM carried on support structure 7, portions of which are also shown in various sectional views in FIGS. 8, 9 and 10. Details given below with reference to the illustrated drive mechanism DM will serve herein as an example of the numerous possible drives that will be suited for use in rotating the water ride in accordance with the invention, and should not be construed as limiting of the invention in any way. In the example, drive mechanism DM includes a motor M which imparts drive rotation to a pair drive/load wheels D/Lw via a chain CH guided about a pulley system. Upper and lower rotational support steel tracks Up/T and Lw/T, respectively, are provided in channels in an exterior of the tube 1, in which lower drive/load wheels D/Lw and upper load wheels Lw run. Drive/load wheels D/Lw are conveniently of a conventional type constructed to drive the lower steel track Lw/T utilizing a tire specification advantageously suitable for rotating this type of feature in both wet and dry conditions. A pair of load wheels Lw in upper positions are provided for additional support of the tube 1 resting thereon. Drive/load wheels D/Lw and load wheels Lw are carried on track wheel main plate TWMP. Only load wheels Lw are carried on upper track wheel main plate TWMP'. Thrust bearings (wheels) Th/w vertically support the tube 1 (inclined support), for example, in conventional manner.

Commercially, it is contemplated that the revolving water ride 10 in accordance with embodiment of the invention will be available in various sizes (length/diameters), for example catering to transport of children only, for larger inflatable carriers for one user, and for two and four user inflatable carriers. Inclines of the water ride according to the invention advantageously range between about 20 and 35 degrees, to accommodate the requirements of each individual site.

From a design standpoint, the various ride types which incorporate the features according to the invention will advantageously provide for a given volume of water within the profile pitch, sufficient for the use of an inflatable carrier of suitable dimension, to safely hold and protect the ride participants during transit to a higher level.

The internal threaded profile 2*a* of spiral coil 2 is advantageously smoothly contoured to avoid injury, together with providing a functional and safe entry and exit from the revolving water ride 10 in accordance with the invention.

Figure 11:
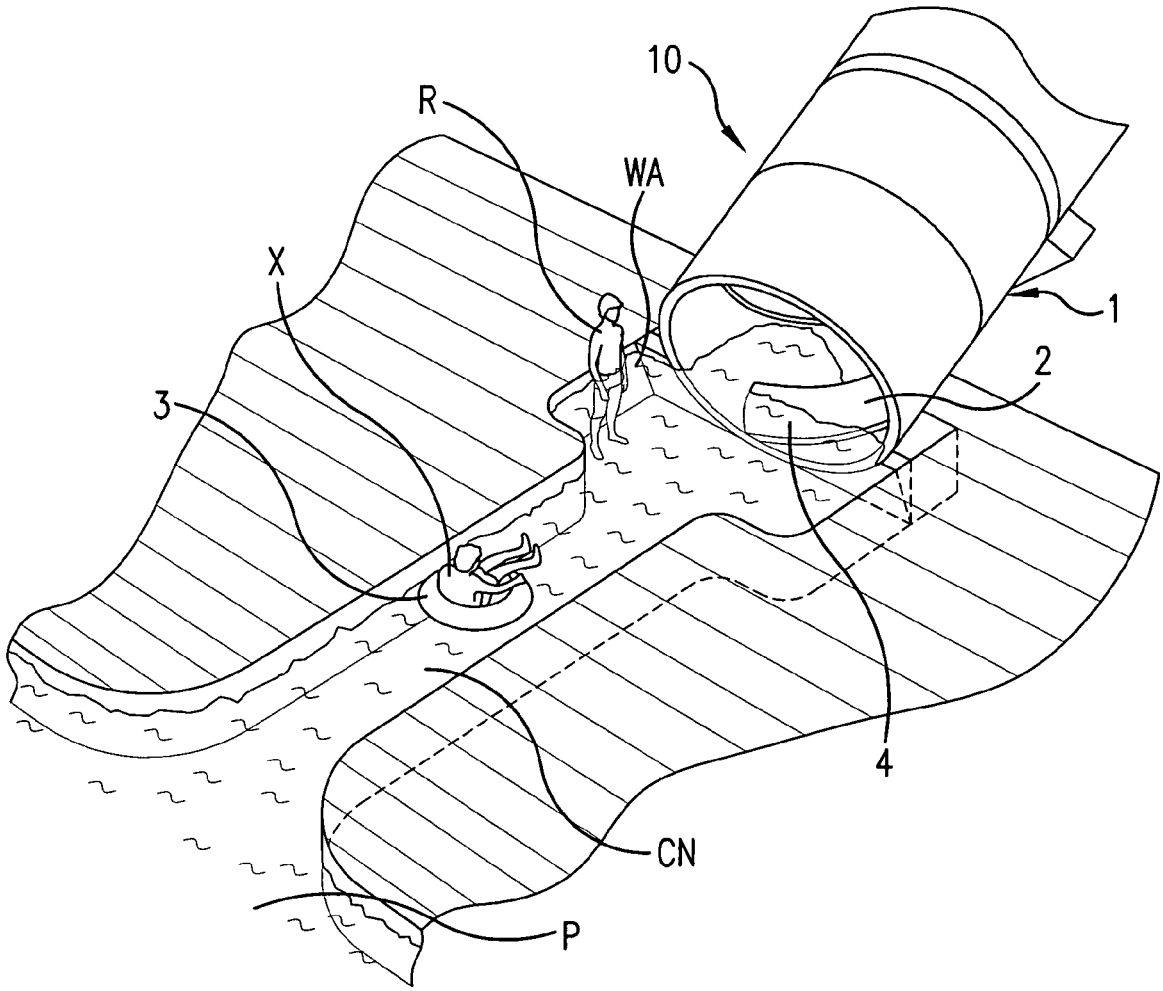
FIG. 11 is a perspective view depicting an optional entry channel to the water ride according to the invention.

Referring now to FIG. 11, the lower level entry area 4 of the revolving water ride 10 is optionally formed to include a channel CN, utilizing the associated venue or swimming pool water and existing pool surround P, in order to guide a participant X (swimmer or participant on a floatation device 3) towards the beginning of the ride 10. Water movement in the direction of the entry to the revolving ride 10 is naturally created by the volume of water taken by each pitch revolution of the internal profile as the ride rotates, providing a steady water flow along and towards the entry area. A widened area WA can optionally be provided to allow clearance for a ride attendant R to stand and assist the participant X when necessary.

Figure 12:
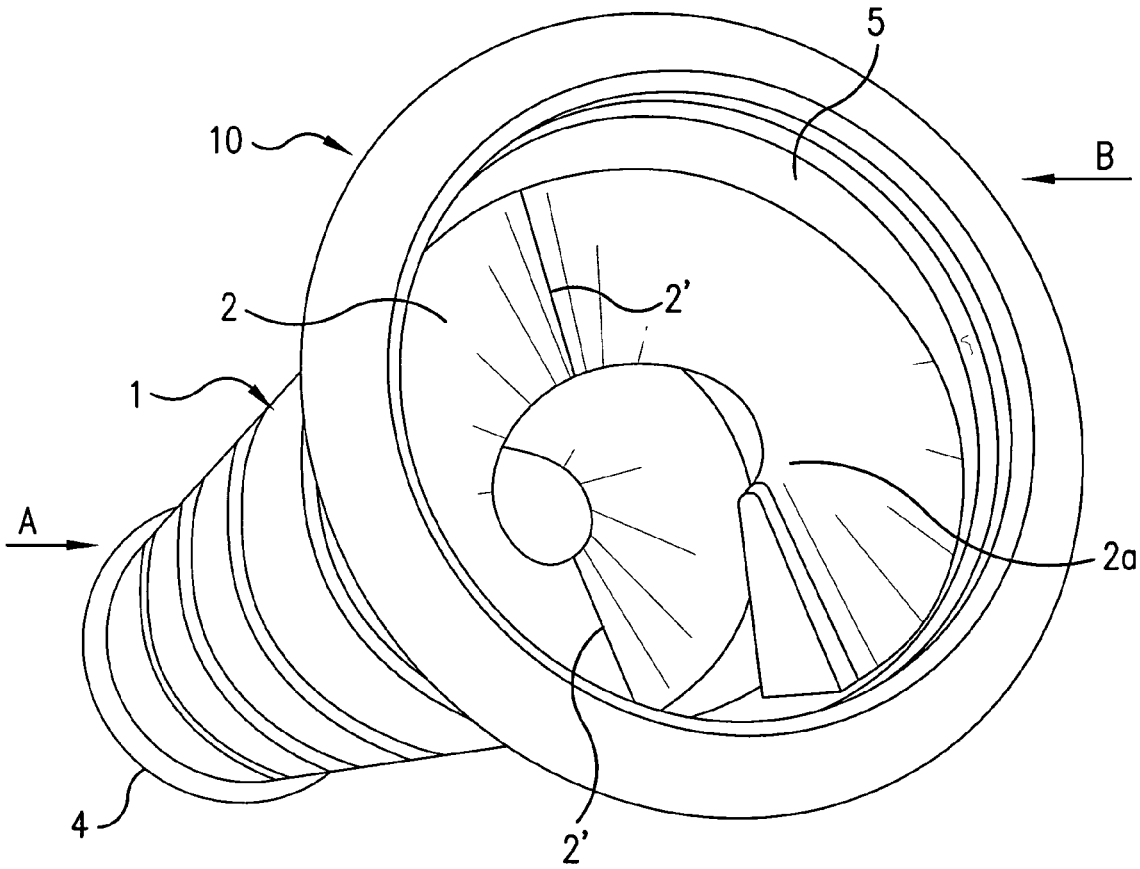
FIG. 12 is a perspective view of an exit end of the water ride according to the invention showing the formation of the internal hollow threaded profile of the spiral coil received in the outer tube.

Turning now to FIG. 12, which is a perspective view of an exit end of the water ride 10 according to the invention showing the formation of the internal hollow threaded profile of the spiral coil 2 received in the outer tube 1 of the water ride 10, the spiral coil structure 2 in the particular example depicted is constructed collectively from coil segments 2" traversing 180 degrees, thereby having a junction therebetween, as shown, which roughly bisects a cross-section of outer tube 1. An end profile 8 is attached to the last coil segment 2" to finish the spiral coil structure 2 and allow smooth exit of the ride participant from water ride 10.

Figure 13:
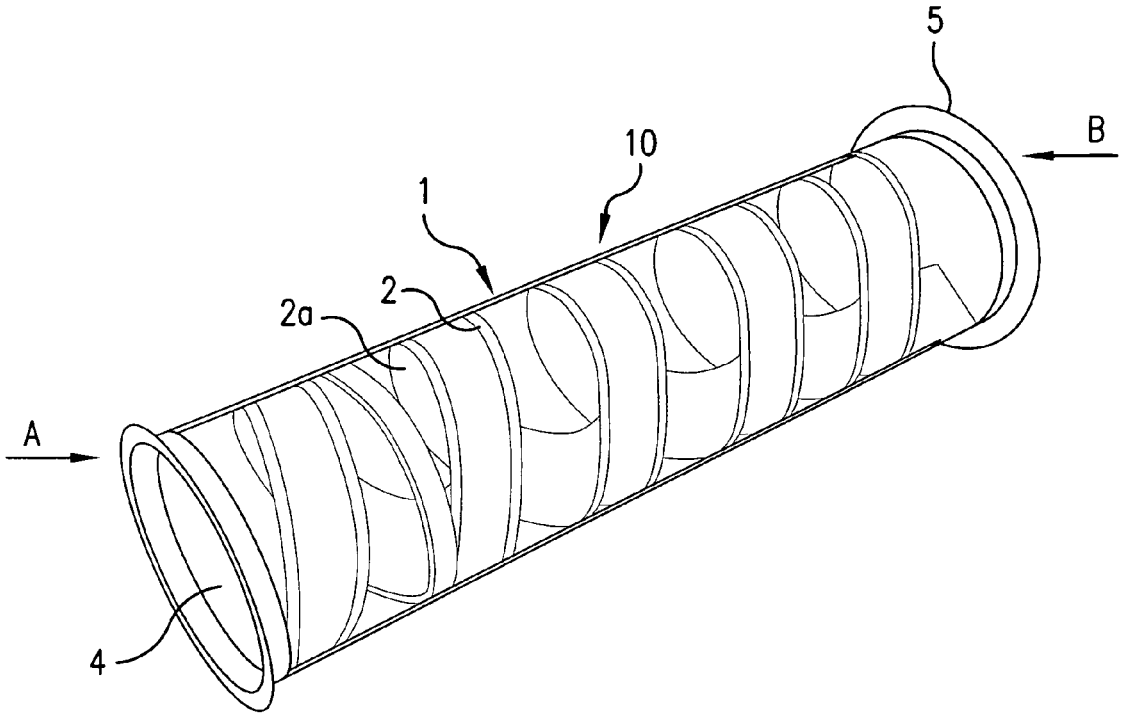
FIG. 13 is a perspective side view showing the general assembly of the outer tube and spiral coil defining the helical threaded internal profile.

FIG. 13 is a perspective side view showing the general assembly of the outer tube and spiral coil defining the helical threaded internal profile.

As noted above herein, construction of the rotating water ride 10 according to embodiment of the invention is based on the use of a main external tube (structural outer tube 1), and an advantageously smoothly profiled continuous internal spirally coiled thread (defined by spiral coil 2). Both elements 1, 2 can be constructed of various materials, the most practicable being glass-fiber reinforced plastic, (GRP), thereby providing a very substantial and suitable load bearing structure, together with the very high quality internal surface finish obtainable from this material (fiberglass), as well as conforming to typical health and safely guide lines. Construction of the various component can be accomplished, for example, by suitable conventional approaches.

A translucent material finish is advantageously applied to the structural outer tube 1 which is equivalent to an approximate 60% light value or greater. While not necessarily having total transparent clarity, this material will advantageously be used to visually identify the safe and uniform way that ride participants ascend the revolving water ride.

The revolving water ride site assembly components will be conveniently selected on the same basis as that applied to conventional GRP water rides and flumes, utilizing, for example, galvanized steel support structures, stainless steel assembly fixings and various type sealants.

It will be understood that, in practice, since the revolving water ride according to the invention being of a rotational type installation, it is essential from a safety standpoint that all moving parts are well out of reach of the public and ride participants. While examples of such protective security features are not depicted herein, each installation will advantageously have its own set of safety requirements, which from past comprehensive experience means that every moving junction/part must conform to all health and safety requirements, and will be ascertained at the initial site survey/installation, and approved by those responsible prior to commissioning the feature.

It is noted that the depictions herein only show the immediate entry and exit pools, not extensions to other rides or features, which will be readily understood by one skilled in the art, and therefore omitted as unnecessary.

It is further noted that reference to scale is not shown in the drawings, the features according to the invention having a wide user range, for example, including specific suitability for children and multiple rider carriers.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A water ride, comprising:

an outer tube structure; and a spiral coil structure presenting a generally helical pitch profile defining an internal screw thread fixable to an interior wall of said outer tube structure, said internal screw thread extending only partially radially inward from the inner wall of the outer tube structure such that there is a central hollow area which is not obstructed in any way by a configuration of the internal screw thread.

2. A water ride according to claim 1, wherein the spiral coil structure is comprised of an assembly of sub-elements including coil segments which collectively defines the helical pitch profile of the spiral coil structure when said sub-elements are mutually aligned and secured to the outer tube.

3. A water ride according to claim 2, wherein said coil segments include flanges for securement to the interior wall of the outer tube structure by suitable fasteners.

4. A water ride according to claim 1, wherein a manner of securement permits removal of at least a portion of the spiral coil structure from said outer tube structure as required.

5. A water ride according to claim 1, wherein at least one of the spiral coil structure or the outer tube structure is comprised of an assembly of sub-elements which collectively define at least one of the spiral coil structure or the outer tube structure when mutually aligned with, or secured to, one another.

6. A water ride according to claim 1, wherein said outer tube structure is comprised of an assembly of sub-elements which collectively define the outer tube structure when mutually secured to one another.

7. A water ride according to claim 6, wherein said sub-elements include flanges for securement of said sub-elements one to another in at least one of a circumferential direction or an axial direction.

8. A water ride according to claim 1, wherein at least a portion of said outer tube structure or said spiral coil structure is comprised of glass-fiber reinforced plastic.

9. A water ride according to claim 1, wherein said outer tube structure is configured such that water is containable within an interior of the outer tube structure.

10. A water ride, comprising:

an outer tube structure;

a spiral coil structure presenting a generally helical pitch profile defining an internal screw thread fixable to an interior wall of said outer tube structure, the spiral coil structure being comprised of an assembly of sub-elements including coil segments which collectively defines the helical pitch profile of the spiral coil structure when said sub-elements are mutually aligned and secured to the outer tube, said coil segments including flanges for securement to the interior well of the outer tube structure by suitable fasteners; and a seal being provided between at least ones of said flanges and said outer tube structure which contact water pockets contained between a pitch of said helical pitch profile.

11. A water ride according to claim 10, wherein at least a portion of said outer tube structure or said spiral coil structure is comprised of glass-fiber reinforced plastic.

12. A water ride, comprising:

an outer tube structure;

a spiral coil structure presenting a generally helical pitch profile defining an internal screw thread fixable to an interior wall of said outer tube structure; and a rotational drive mechanism, at least a portion of said rotational drive mechanism being configured to apply rotational force in a radial direction of said outer tube structure crosswise to a longitudinal axis thereof, for imparting rotation to said outer tube structure.

13. A water ride according to claim 12, wherein a manner of securement permits removal of at least a portion of the spiral coil structure from said outer tube structure as required.

14. A water ride according to claim 12, wherein at least one of the spiral coil structure or the outer tube structure is comprised of an assembly of sub-elements which collectively define at least one of the spiral coil structure or the outer tube structure when mutually aligned with, or secured to one another.

15. A water ride according to claim 12, wherein said tube structure is comprised of an assembly of sub-elements which collectively define the outer tube structure when mutually secured to one another.

16. A water ride according to claim 15, wherein said sub-elements include flanges for securement of said sub-elements one to another in at least one of a circumferential direction or an axial direction.

17. A water ride according to claim 16, wherein a seal is provided between each confronting pair of said flanges.

18. A water ride according to claim 12, wherein at least a portion of said outer tube structure or said spiral coil structure is comprised of glass-fiber reinforced plastic.

19. A method of moving a water ride participant between two pools of different elevations, the method comprising:

securably arranging a spiral structure presenting a generally helical pitch profile within an outer tube structure;

at least partially submerging an entry end of the tube in one of the pools such that water pockets are trapped between the pitch profile;

positioning an exit end of the outer tube at the second pool; and rotating the tube such that the water pockets are advanced from the entry end of the outer tube structure to the exit end of the outer tube structure, the water ride participant entering via the entry end being carried along with a particular one of the water pockets in which the water ride participant is held and ultimately discharged from the exit end into the second pool.

20. A method according to claim 19, wherein said pitch profile extends only partially inward of an inner wall of the outer tube thereby leaving a hollow region centrally of the tube.

* * * * *